United States Patent [19]

Peters

[11] Patent Number: 4,509,571

[45] Date of Patent: Apr. 9, 1985

[54] APPARATUS FOR FORMING I-BEAM TRUSS STRUCTURE

[76] Inventor: Dierk D. Peters, P.O. Box 137, Rancho Santa Fe, Calif. 92067

[21] Appl. No.: 391,231

[22] Filed: Jun. 23, 1982

Related U.S. Application Data

[63] Continuation of Ser. No. 60,908, Jul. 26, 1979, Pat. No. 4,336,678, which is a continuation-in-part of Ser. No. 927,618, Jul. 24, 1978, abandoned.

[51] Int. Cl.[3] ..... B27M 1/02

[52] U.S. Cl. ..... 144/2 R; 29/121.1; 72/197; 100/158 R; 144/358; 156/209

[58] Field of Search ..... 100/158 R, 176; 144/358, 2 R; 156/206, 209, 220; 493/463; 72/167, 197, 198; 29/121.1

[56] References Cited

U.S. PATENT DOCUMENTS

| | | | |
|---|---|---|---|
| 2,364,780 | 12/1944 | DeWalt | 72/197 |
| 2,769,479 | 11/1956 | Getz | 29/121.1 |
| 3,240,148 | 3/1966 | Varga | 100/158 |
| 3,320,044 | 5/1967 | Cole et al. | 156/206 |
| 3,499,305 | 3/1970 | Abernathy | 72/197 |
| 3,672,926 | 6/1972 | Ramey | 144/358 |
| 3,765,974 | 10/1973 | Petersik | 156/209 |
| 4,122,589 | 10/1978 | Grimm et al. | 72/167 |
| 4,139,407 | 2/1979 | Etzold | 156/209 |

FOREIGN PATENT DOCUMENTS

| | | | |
|---|---|---|---|
| 177241 | 10/1906 | Fed. Rep. of Germany | 100/158 R |

*Primary Examiner*—W. D. Bray

*Attorney, Agent, or Firm*—Knobbe, Martens, Olson & Bear

[57] ABSTRACT

A wooden truss structure comprises upper and lower chords, each of which is grooved on the side facing the opposite chord. A web member formed of sheet material, such as plywood, interconnects the chords and fits within the chord grooves. At the web/groove interface, the webs are scalloped to provide alternating alignment guide areas and glue vent areas which extend above the interface and allow the escape of excess glue from the groove. The scalloping, in addition to venting the glue line, forms individual, pressurized glue pockets which assure even glue distribution. The scalloping is preferably provided by pressing the wood web material to compress it at the glue vent areas and thus permit the web member, due to its memory, to expand after contact with the glue. This expansion pressurizes the glue pockets and forces glue from the joint area into the wood further enhancing the expansion process. The web is rigidly bonded to the chord members, all while being aligned by the alignment guide portion. Ths scalloping is effected along the lateral walls of the web at right angles to the longitudinal dimension of the web and consists of compressing the wood so that the impressions are deeper at their bottom than at their top.

12 Claims, 18 Drawing Figures

11
13
15
17
19
21
23
25
27
28
29
29A
29B
31
33
35
37
39
41
43
45
47
49
5,7
6
77

Fig. 9
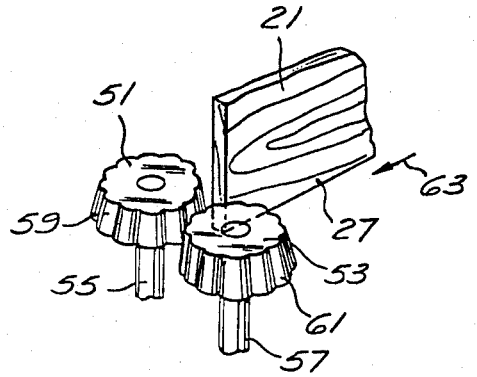
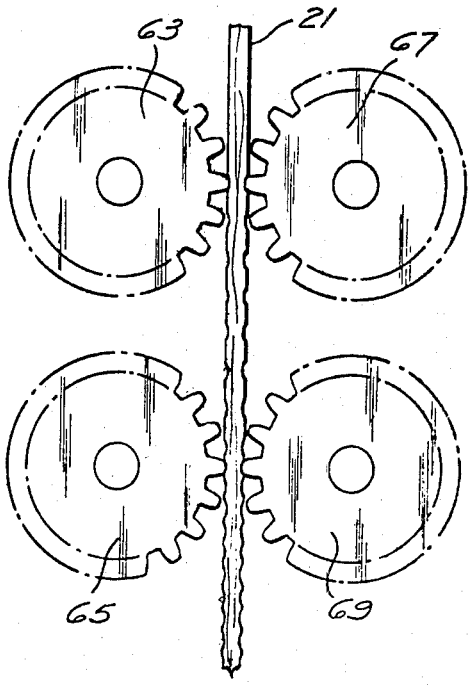
Fig. 10
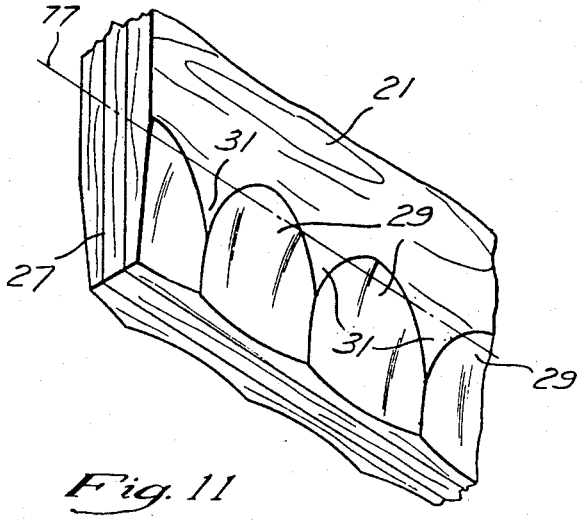
Fig. 11

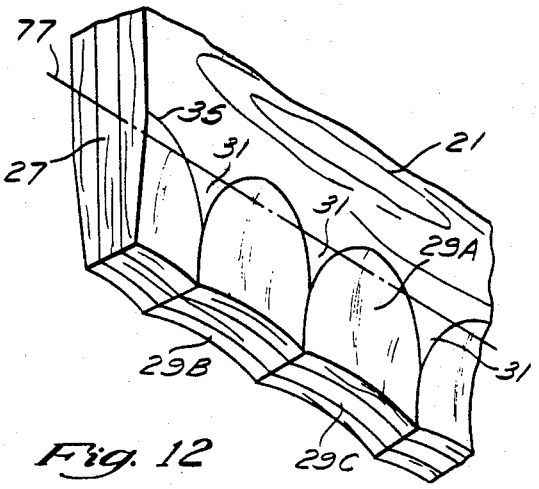
Fig. 12
Fig. 13
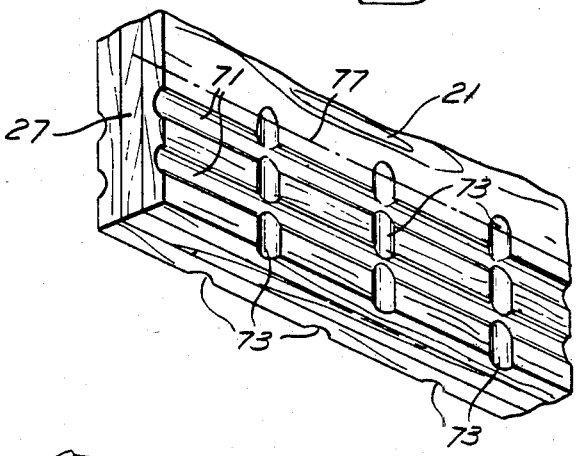
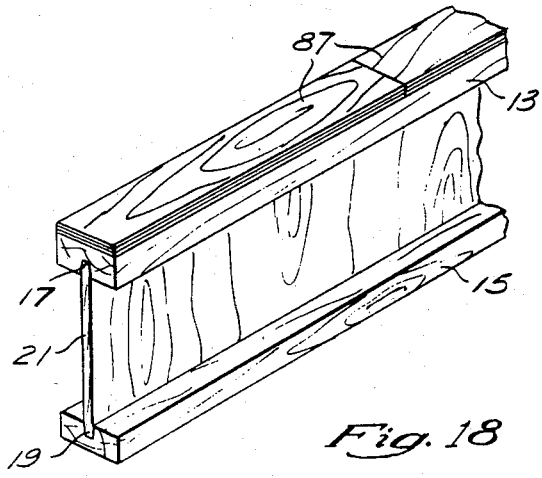
Fig. 18

APPARATUS FOR FORMING I-BEAM TRUSS STRUCTURE

RELATED APPLICATION

This application is a continuation of application Ser. No. 60,908, filed 7-26-79 now U.S. Pat. No. 4,336,678 which is a continuation-in-part of my application, Ser. No. 927,618, filed July 24, 1978, now abandoned.

BACKGROUND OF THE INVENTION

This invention relates to wooden-type truss structures which include upper and lower wooden chords interconnected by webs formed of wooden sheets. Both the chord members and the webs may either be solid wood members or composite or laminated wooden members, as desired. Such truss structures have been constructed extensively in the prior art and are typically characterized by a pair of beams running parallel to one another or angled relative one another to form a roof incline, with the webs spanning these chords in a plane intersecting both chord axes. As has been recognized by the prior art, the greatest difficulty encountered in the construction of such truss structures is the web/chord joint formed at the chord groove. Enough of the web cross-section must remain at the joint to prohibit sheer forces from rupturing the web member adjacent the chord. At the same time, however, the joint must provide substantial surface interface for gluing purposes. In addition, it is preferable that these desirable objects be accomplished without a requirement for long duration clamping devices to maintain alignment of the structures during curing of the adhesive used for their interconnection.

In the prior art, it has been shown that it is possible to increase the surface area of glue contact by grooving the web member to provide multiple grooved interconnections between the web member and each of the chords. Such an attempted solution is shown, for example, in U.S. Pat. No. 4,074,498, in U.S. Pat. No. 3,991,535, and in U.S. Pat. No. 3,960,637. Unfortunately, these attempted solutions substantially increase the cost of fabrication, since additional grooving and additional fitting of grooves, all requiring close tolerance mill work, are required. Of even more importance is the fact that increased surface area at the glue joint is provided only at the expense of a lack of sheer strength at the web/chord interface, since the cross-section of the web is typically substantially reduced by internal grooves near the interface, so that the structural integrity of the web itself is degraded.

Other solutions to the problem have suggested a compression of the web at its edges and the placement of the compressed or tapered edges into tapered grooves to provide self-pressurizing joints as the wood, which has been previously compressed, expands in response to the glue's moisture. Unfortunately, this solution, as presented in U.S. Pat. No. 3,490,188, for example, does not provide adequate venting for glue. Thus, if the groove in the chord is partially filled with glue, the web will often not completely enter the groove, even under pressure, since the glue cannot be vented from the groove during assembly. Furthermore, even if all of the glue is vented, it is unlikely, using the system of that patent, that the glue will be evenly vented to assure coating of all of the interface surfaces. Rather, the glue tends to vent from portions having softer wood surfaces or indentations, finding a single path of least resistance, so that much of the surface area may remain uncoated and therefore not contribute to the structural integrity of the joint.

In the prior art, the edges of the web in above configurations, whether they were tapered edges or multiple groove interconnections, have always been machined or compressed along the longitudinal dimension of the web. This was done because such forming of the wood of the web was easier and it facilitated the handling of the workpiece.

In the prior art it has been thought necessary to use configurations, such as those described above, in order to pressurize and align the joint interface without external clamps. Thus, it has been thought necessary to either risk the loss of sheer strength at the joint or to risk poor adhesive coverage at the joint in order to bond the structure without clamps which remain in place during the assembly and curing processes.

SUMMARY OF THE INVENTION

The present invention, on the other hand, provides a web/chord interface for wooden composite beams which permits the entire web cross-section to remain intact at the joints in order to maintain the structural integrity of the web, while providing adequate, distributed glue venting along the joint so that glue placed in the chord groove will be uniformly vented and distributed, during assembly and thereby coat substantially the entire web/chord interface joint surface. At the same time, the venting apertures are preferably provided by pressing, rather than cutting the wood, so that, in response to the absorbed moisture of the adhesive used to provide the joint, the vents are slowly closed after assembly and automatically provide a pressure bond with the chord member.

Unlike the prior art, the venting apertures are formed at right angles to the longitudinal dimension of the web. The impressions are preferably deeper near their bottom than their top in order to provide, in cooperation with the tapered sides of the chord groove, even glue distribution over the entire web/chord interface. Furthermore, these vent areas extend above the top of the groove to allow excess glue to escape the pressurized pockets formed when glue at the top of the vents dries, causing them to become sealed. The expansion of the compressed wood causes pressure build-up in the vents driving even more glue into the wood.

Alternating with the vent areas are alignment surfaces which are formed at a different cross-sectional configuration than are the vent areas. These alignment surfaces provide alignment and temporary attachment of the members during curing of the adhesive so that no long duration clamps are required in manufacturing the trusses. Thus, clamping is required for initial assembly, but not during the longer duration glue setting time.

These and other advantages of the present invention are best understood through a reference to the drawings, in which:

FIG. 9 is a schematic view showing a second method and apparatus for scalloping the edge of the web member of FIG. 1;

FIG. 10 is a schematic view showing a third method and apparatus for scalloping the edge of the web member of FIG. 1;

FIG. 11 is a broken-away perspective view, similar to FIG. 4, showing an enlarged portion along the edge of a web wherein the vented areas overlap slightly;

FIG. 12 is a perspective view, similar to FIG. 11, showing an edge of a web that has vented areas on both its sides and bottom;

FIG. 13 is a perspective view of an edge of a web which has horizontal and vertical corrugations for the venting and distribution of glue;

Figure 15:
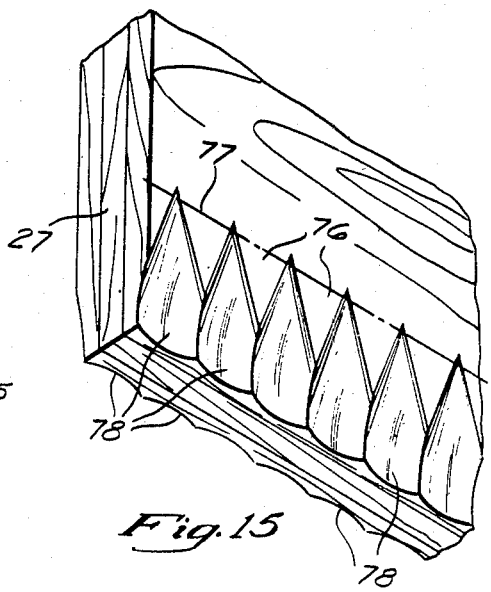
Figure 16:
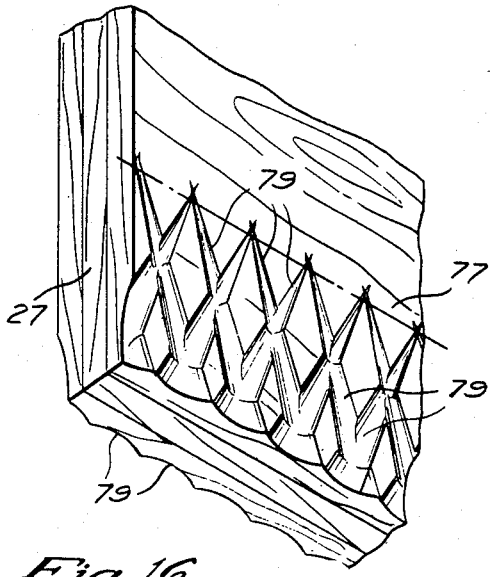
Figure 17:
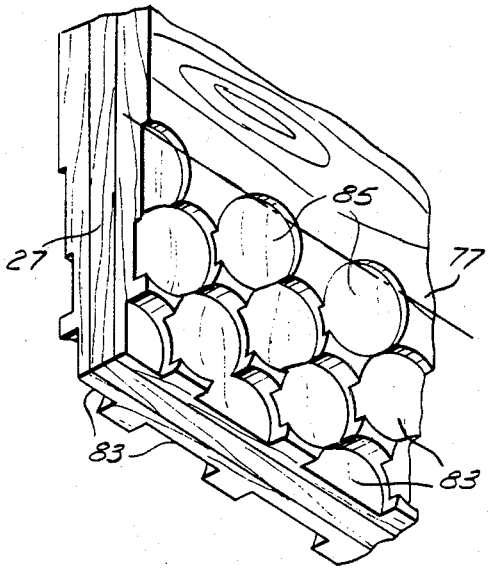

FIG. 15 also illustrates in perspective a web with intersecting triangular impressions;

FIG. 16 is a perspective view illustrating a web edge having triangular impressions which intersect at least two other such impressions;

FIG. 17 illustrates the edge of a web having interlocking, circular pockets at variable depths for glue ventilation and distribution; and FIG. 18 illustrates in perspective a completed I-beam truss with a panel attached to the upper surface of the upper chord.

DETAILED DESCRIPTION OF THE PREFERRED EMBODIMENT

Figures 1, 2, 3, 4, 5, 6, 7, 8:
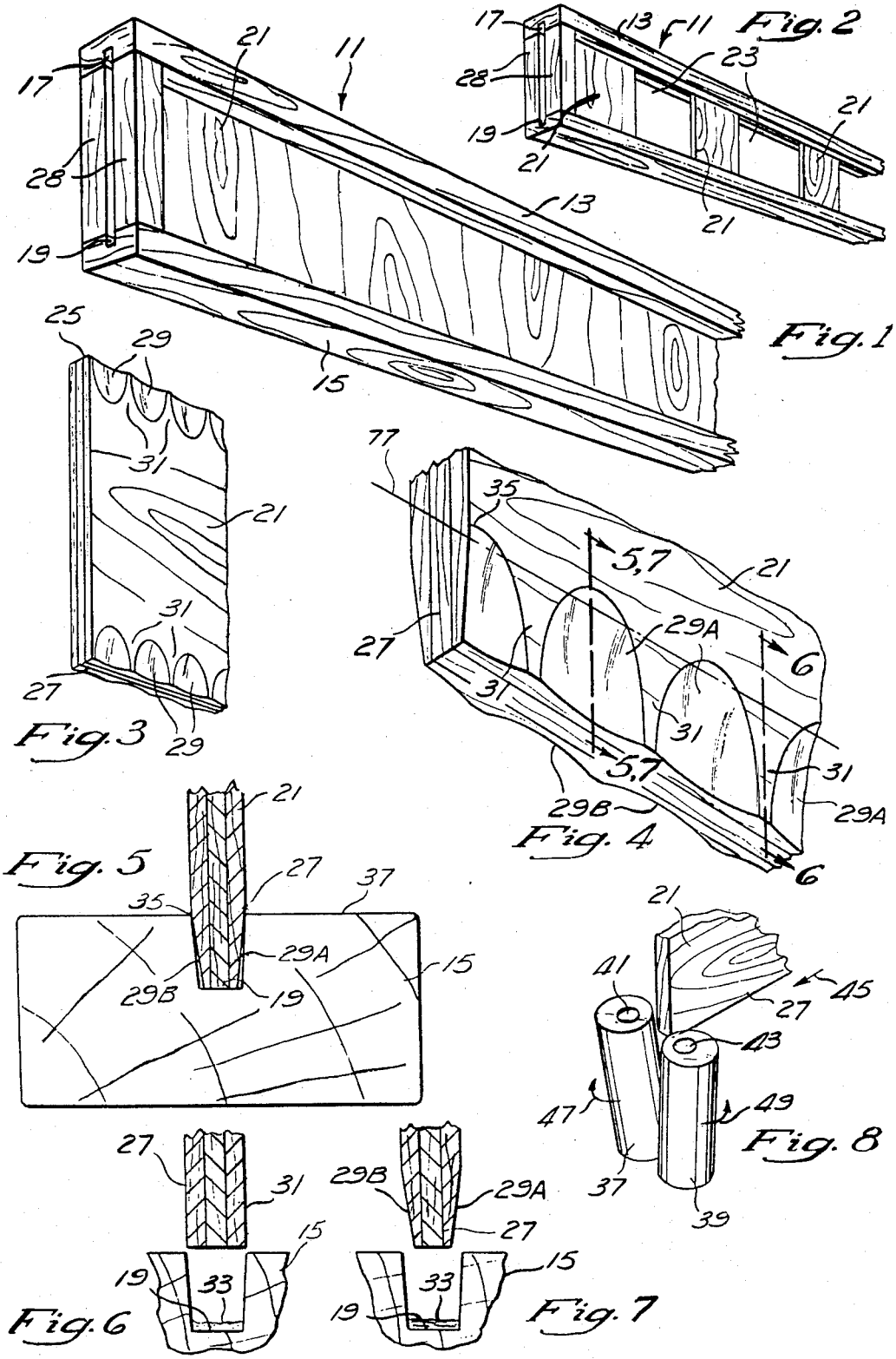
FIG. 1 is a perspective view of a wooden composite truss which is constructed in accordance with the present invention.
FIG. 2 is a perspective view, similar to FIG. 1, showing a truss with discontinuous web members.
FIG. 3 is a perspective view of the end portion of the web of the truss of FIG. 1.
FIG. 4 is a broken-away perspective view showing an enlarged portion along the edge of the web of FIG. 3.
FIG. 5 is a sectional view taken through the chord-/web interface of FIG. 1 at a vent location, the section location identified at line 5—5 in FIG. 4, to show the interrelationship of the members at this cross-section.
FIG. 6 is a partial sectional view showing the edge of the web member of FIG. 1 and the chord at an alignment surface section, this section location identified at line 6—6 in FIG. 4, just prior to insertion of the web into the groove.
FIG. 7 is a view similar to that of FIG. 5 but showing the relationship at this point during assembly of the vent section, line 7—7 of FIG. 4, of the web edge.
FIG. 8 is a schematic representation illustrating a first method and apparatus for scalloping the edge of the web member of FIG. 1.

Referring initially to FIG. 1, a truss 11, constructed in accordance with the present invention, is shown to comprise an upper chord member 13 and a lower chord member 15. In the form of the truss shown in FIG. 1, the chords 13 and 15 extend in a parallel relationship to form the upper and lower flanges of an I-beam. It will be understood by those skilled in the art that if the truss 11 is to be used as a combination ceiling joist and roof rafter, the chord 13 may not extend parallel to the chord 15, so that a roof slope may be provided by the combined structure 11.

In the embodiment shown in FIG. 1, each of the chords 13 and 15 is formed of a solid piece of wood. In an illustrative example, these chords 13, 15 may be formed of two-by-fours, with the one and five-eights inch dimension extending in the combined plane of the chords 13, 15 and the three and five-eights inch dimension extending normal to that combined plane. The chords 13, 15 include grooves 17 and 19, respectively, which grooves are, in the preferred embodiment, centrally located on the wide face of the chords 13, 15 which face one another. Thus, these grooves 17 and 19 are aligned to receive the opposite edges of a web member 21.

Those skilled in the art will recognize the fact that the web member 21, shown in FIG. 1, may, if desired, comprise a single length of wooden sheet so that no voids are left between the chords 13 and 15. Alternatively, the construction shown in FIG. 2, in which webs 21 alternate with spaces 23 may be used. The configuration most practical for a given application will depend upon the sheer strength necessary in the web portion of the composite beam. Except for the form of the web member 21, the truss structures of FIGS. 1 and 2, as well as the design at the chord/web interface, to be described below, is identical.

The web members 21 are conveniently fabricated from plywood. Other thin wooden boards, of course, or fabricated wooden sheets, may be substituted, just as a laminated structure may be substituted for the solid chord members 13 and 15.

The grooves 17 and 19 are slightly tapered, as will be described in more detail below. The grooves 17 and 19 receive opposing edges 25 and 27 of the web members 21, which edges 25,27 are scalloped. Those skilled in the art will recognize the fact that the overall structure of the composite I-beam 11 is typical of those used in the prior art. The invention, in this instance, is the manner of attaching the edges 25,27 of the webs 21 within the grooves 17,19, respectively.

In many instances, it is preferable to block the ends of the truss 11 with vertical posts 28 which span between the chords 13,15. The posts 28 permit the ends of the truss 11 to be supported on a wall beneath the chord 15, with the posts 28 distributing a portion of the end shear load to the chord 13.

Referring to FIGS. 3 and 4, it can be seen that both the upper and lower edges 25,27 of the webs 21 comprise a series of alternating scallops 29 and intervening planar areas 31. The scallops 29 are typically formed by compressing the edges 25,27 between rollers so that opposite sides of the web 21 at each edge 25,27 are identically compressed. Thus, as is best seen in FIG. 4, the scallops 29A on one side of the edge 27 conform with opposing scallops 29B on the opposite face of the edge 27. As will be more completely described below, the opposing scallops 29A,29B form glue channels during assembly of the truss of FIG. 1 which vent glue from the grooves 17,19, and spread glue uniformly to assure an adequate glue coverage of the entire joint area. In addition, these opposing scallops 29A,29B provide an expanding surface when they react with the liquid in glues. This expansion is due to the wood's memory which responds to moisture. The expansion clamps the edges 25 and 27 within the grooves 17,19 of the chords 13 and 15 during the curing of the glue so that the entire glue line is pressurized during curing of the glue.

During assembly of the truss of FIG. 1, and prior to expansion of the scalloped areas 29, the planar unscalloped areas 31 serve to align the edges 25,27 within the grooves 17,19 of the chords 13,15, respectively, and at the same time form outer perimeters for the individual glue pockets or channels formed by individual scallops 29. Thus, as the edge 27 of the web 21 is inserted into the groove 19, glue within the groove 19 will be forced under pressure away from the edge 27, channeled by the scallops 29A. Each scallop 29A will capture a small amount of glue and channel it to cover the surface area of the scallop, with the unscalloped areas 31 acting as barriers to permit individual glue pressurization and spreading within each of the scallops 29A.

This interrelationship between the scalloped edges 25,27 and the grooves 17,19 is best shown in FIGS. 5, 6, and 7, which illustrate schematically the assembly process. FIG. 5 is a section taken at the middle of a scallop 29A,29B, along line 5—5 of FIG. 4, after the edge 27 has been fully inserted into the groove 19. It will be seen that, prior to expansion of the wood fibers at the scallops 29, in reaction to the liquid in the glue, the scallops 29 have a more acute taper than does the groove 19. Thus, the scallops 29A and 29B, in cooperation with the groove 19, form a plurality of thin glue channels, each of which distributes and vents a small amount of glue to provide an even distribution of glue on both sides of the edge 27. Furthermore, the taper of the scallops 29A and 29B can extend above the groove 19 so as to allow the escape of excess glue completely out of the web/chord interface. FIG. 4 illustrates these scallops 29A which extend above the top of the chord, indicated at line 77.

FIGS. 6 and 7 show sections through the planar areas 31 (line 6—6 of FIG. 4) and scalloped areas 29 (line 7—7 of FIG. 4), respectively, just prior to insertion of these sections into the groove 19. It will be seen that in a typical application, glue 33 is applied to the bottom of the groove 19. This glue 33 will be spread over the surfaces of the joint by pressure, which is generated as the edge 27 is inserted into the groove 19. The planar area 31 will be a tight fit within the tapered groove 19. Its width, however, is small enough, that is, the area between adjoining scallops 29 is sufficiently narrow, that it will deform under the pressure used to assemble the webs 21 with the chords 13 and 15. This compression will temporarily lock the members together and serve to accurately align the web 21 with the chords 13 and 15. At the same time, glue cannot pass from one scallop 29 to the next because of the tight fit between the planar area 31 and groove 19 of the joining members.

It will be seen, on the other hand, that, as illustrated in the section of FIGS. 5 and 7, there is space between the joining scallop portion 29 and the groove 19. This space is formed by the more acute taper of the scalloped portion 29; thus, it is widest at the bottom of the groove where the scalloped portion is compressed the most and therefore ultimately will accomodate the most glue thereby enhancing the expansion qualities of the wood at that location.

The taper of the scalloped portion 29 cooperates with groove 19 to form individual pockets in which the glue 33 is distributed. Distribution is caused by the pressure created by the advance of the edge 27 of the web 21 in the groove during insertion. The uniformity and symmetry of the pockets insures that the glue will be distributed evenly along the web/chord interface. Referring to FIG. 4, it will be noted that scalloped portions 29 extend just above the top of the groove 19, indicated at 77, to allow excess glue to be forced out of the web/chord interface by insertion pressure. Venting of excess glue insures complete contact between the mating surfaces of the web and chord and further provides easy and efficient inspection of assembled trusses. That is, the completeness of the glue distribution in the web/chord interface, and ultimately the quality of the bond, can be easily determined by noting whether beads of excess glue appear at the top portion of the scallop areas 29, above the groove 19.

As previously stated, the scallops 29 are formed by compressing the fiber of the edges 25, rather than by cutting away these edges. The glue 33 typically contains moisture which will react with the compressed fiber to activate the wood's memory, so that the wood in the scalloped areas 29 will expand and securely hold edges 25 and 27 within the grooves 29. This expansion further assists in holding the assembled pieces 21, 13 and 15 together as the glue 33 sets, so that, once these members have been clamped together, they may be removed from the clamps and allowed to dry or cure. This ability to assemble the devices without clamping during the curing stage reduces substantially the amount of equipment required to fabricate the truss of FIG. 1. The initial self-clamping of the structure, even prior to expansion of the scalloped areas 29, is accomplished by the tight, compressed fit between the planar areas 31 and grooves 17, 19. This fit holds the parts together as the scalloped areas 29 expand to pressurize the glue joint. The same advantages apply to areas 31 of FIG. 11 wherein scalloped areas 29 overlap slightly. Although the planar area is fore-shortened, it nonetheless accomplishes its holding and alignment functions, while further facilitating insertion of the web.

Thus, it can be seen that the scalloped areas 29 cooperate with other members of the web and chord to perform several important functions. First, the compression of the wood of the edge 27 of the web at right angles to the longitudinal dimension of the web forms an accute taper which, in cooperation with the sides of the groove 19, allows distribution of the glue in a generally vertical direction to insure that the complete web/chord interface is coated with glue. Secondly, the scalloped areas 29 define individual glue dispersion pockets, which are uniform and symmetrical, and which capture equal amounts of glue in order to evenly distribute it along the length of the web. Similarly, excess glue is vented from the web/chord interface to insure complete contact between the mating surfaces of the web and chord. Furthermore, the planar areas 31 between the scalloped areas 29 provide alignment and holding of the web in its proper position in the groove of the chord without the need for clamps, nails or other holding devices during the curing stage.

Finally, the scallops 29 also become individual pressurized pockets causing the compressed wood of the scallops to absorb even more glue than under vented conditions. This condition occurs very simply in the assembly process. During assembly of the web to the chord, the pressure in the interface builds up only at the final stages of insertion when the bottom of the web begins to displace the glue in the bottom of the groove and the planar areas 31 of FIG. 11 enter the groove. The glue is then spread in a generally vertical direction over the face of the scallop portion 29, the taper of the scallop allowing the glue to rise to cover the complete face of the scallop. As the web reaches the bottom of the groove, excess glue is vented out of the groove at the top of the scallop, however, no more than an excess amount of glue is able to escape because the depth of the impression of the scallop 29 at its top is very narrow. Here at the top of the scallop, where the glue line is thinnest and exposed to air, the glue drys, sealing the scallop pocket. Glue in the pockets is absorbed into the compressed wood thereby stimulating the expansion of the impressions which causes pressure buildup in the pocket, driving still more glue into the wood. This extra glue driven into the wood of the scalloped means 29 enhances the expansion of the same, forming a very tight bond in the interface and insuring the complete mating of interface surfaces.

Therefore, this expansion characteristic of the impressed areas of the scalloped portions 29, and the enhancement caused by individually pressurized pockets just described, provides a secure bond between the web and chord members.

FIG. 8 shows schematically a method for scalloping the edge 27 of the web 21. In this case, a pair of forming rollers 37, 39 are rotatably mounted on eccentric axles 41 and 43, respectively, which axles are inclined relative one another. This alignment of the axles 41, 43 forms the general taper of the scallops 29, while the eccentric placement of the axles 41, 43 provides the scalloping action. Thus, when the web 21 is in position for scalloping and the rollers 37, 39 are in a first orientation, they do not touch the edge 27. In this orientation the planar areas 31 are provided. As the web 21 is moved in the direction of the arrow 45, and the rollers 37 and 39 are rolled in the direction of the arrows 47 and 49, respectively, the wider portions of the rollers 37 and 39 contact the edge 27 to form the scalloped indentations 29.

An alternative forming tool is shown in FIG. 9. In this instance, a pair of scalloped inclined rollers 51 and 53 are mounted on axles 55 and 57, respectively. The axles 55 and 57 are parallel to one another and are each concentric with their respective rollers 51, 53. In this instance, scalloping is formed by the shape of the outer periphery 59 and 61 of the rollers 51 and 53 respectively, as the web 21 is moved in the direction of the arrow 63.

A third alternative forming tool is shown in FIG. 10. In this case, four large gears 63, 65, 67 and 69 are mounted on inclined axles, so that the gear pair 63, 65 is inclined relative the gear pair 67, 69. These gears 63–69 are standard items, but are used in pairs so that the gear 69, for example, forms interleaved scallops with those formed by the gear 67. This interleaving is necessary because of the spacing of the teeth on standard gears. The embodiment of FIG. 10 permits a relatively inexpensive web scalloping fixture using off-the-shelf components.

It will be seen that with any of the devices of FIGS. 8, 9, or 10, either the web 21 may be driven past the rollers or the rollers may be driven to draw the web 21 through the device. In either case, guides align the web 21 with the rollers to assure that the scallops 29 are formed at the proper depth. It should be noted that these devices compress the wood generally at right angles to the longitudinal dimension of the web, which is very different from the forming techniques of the prior art.

After using these forming devices, the webs 21 are pressed into the grooves 17, 19 in another fixture (not shown) and then removed. After removal, and until the glue 33 sets, the interference fit of the planar areas 31 and grooves 17, 19 aligns and holds the assembled parts.

Using any of the devices shown in FIGS. 8, 9 or 10, it will be apparent that the edge 27 of the web 21 is alternately compressed to form the scalloped areas 29 and left uncompressed to form the planar areas 31. The taper angle, in either case, is preferably adjusted so that, at the center of the scallops 29, the scallops have a more acute angle than the taper of the grooves 17 and 19, while at the planar portions 31, any taper angle is more obtuse than is the taper angle of the grooves 17 and 19. Thus, the advantages of this invention exist also in the case where the scallops 29 slightly overlap, as shown in FIG. 11. In this case, the planar area is foreshortened, but still accomplishes its holding function.

FIG. 12 depicts a web 21 having scalloped areas 29 along both the sides of lower edge 27, indicated at 29A and 29B, as well as along the bottom, indicated at 29C. The scalloped areas 29C provide the same advantages as those along the lateral walls of the web by venting glue in the bottom of groove 19 along the bottom of the web. At the same time, they provide for the even distribution of glue along the bottom by acting as glue pockets. The uppermost portions of the scallops 29A and 29B can extend above the top of the chord, shown at 77, to allow venting of glue outside the web/chord interface.

Furthermore, if the scalloped areas 29C are formed by compressive techniques, the moisture of the glue will stimulate the expansion of these areas and securely bond the bottom of the web to the bottom of the groove. These areas may be formed utilizing methods similar to those illustrated in FIGS. 8 and 9, except that only a single roller device would be required instead of the opposed pair as shown in those drawings. It should be understood that the scalloped areas 29C can be used separately from or in conjunction with the areas 29A and 29B. If used in conjunction, however, alignment of areas 29C with areas 29A and 29B helps to vent the glue from the bottom to the sides of the web 21.

Those skilled in the art will recognize that the embodiment shown in the figures is illustrative and that the invention can be practiced, for example, by tapering, to some extent, the portions shown as planar 31 in the drawings, so long as an undulating edge is formed to provide individual glue pockets which can separate and spread the glue at the glue line. Such undulation, as previously described, also provides intervening areas which form barriers for the glue pockets and which serve to align and hold together the assembled pieces during their initial assembly. All of this is accomplished while still providing a system which uses the natural memory of the compressed edge 27 to permit the scalloped areas 29 to expand in reaction to the glue and further grip the grooves 17 and 19 to hold the assembled members together during curing of the glue.

As shown in FIG. 13, the ventilation of glue along the sides of edge 27 can be enhanced through the use of horizontal corrugations 71. As with the embodiments of the present invention described above, these horizontal impressions aid in the spreading of glue along the sides of the edge 27 of the web and result in a secure connection between the web and the chord. The embodiment shown in FIG. 13 can be combined with vertical corrugations 73 which serve to supply the longitudinal corrugations 71 with glue from the groove 19, and to vent glue from both grooves 71 and 73. As in previous embodiments utilizing scallops, the vertical corrugation 73 can extend above the top of the chord, shown at 77, to vent glue from the web/chord interface.

Figure 14:
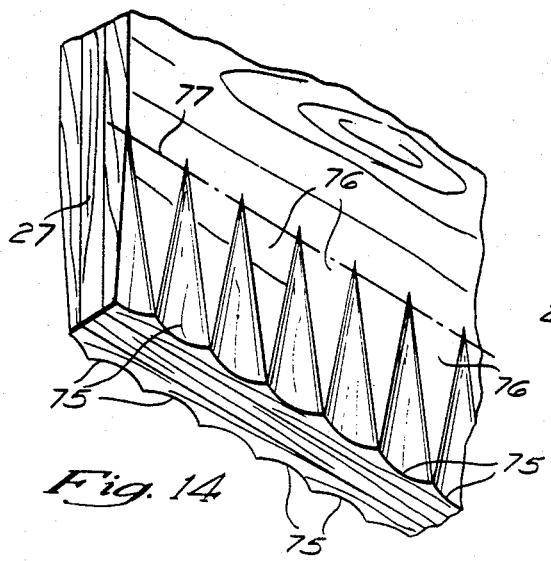
FIG. 14 is a perspective view of an edge of a web having triangular impressions.

FIGS. 14, 15 and 16 illustrate three more embodiments of the present invention in which impressions in the side of the web are utilized to vent and evenly distribute glue from the groove 19 to form a secure and uniform bond along the entire web/chord joint surface. FIG. 14 illustrates sharply pointed impressions 75 in the lower edge 27 of the web which have the shape of longitudinal cross-sections taken through the mid-point of a cone; that is, they become deeper as they approach the bottom surface of the web.

FIG. 15 shows similar cone shaped impressions 78 which overlap so that the portions of the web between them do not extend to the bottom surface. Like impressions 75, the impressions 78 are deeper as the bottom of the web is approached. This variation in the depth of impressions 75 and 78 allows the glue in the groove 19 to be distributed evenly within the web/chord interface. The portions of the web between both types of impressions are alignment areas 76 which allow the web to be properly positioned within the groove 19 of the chord so that the need for clamps or other fastening devices is eliminated. As shown in FIGS. 14 and 15, the impressions 75 and 78 are sufficiently long to enable excess glue to be vented above the top of the web/-chord interface, illustrated by line 77.

FIG. 16 depicts a web in which impressions 79 are angled with respect to one another so that they intersect two other such impressions along the side of the edge 27 of the web. The impressions 79 can either be conical, such as those of FIGS. 14, 15 and 16, and therefore having a greater depth at the bottom of the web than at their tops or they can be uniform in depth (not shown). In either case, the impressions extend above the web/-chord interface line 77 to allow venting of the glue outside of the groove 19.

FIG. 17 illustrates an embodiment of the present invention in which circular pockets 83 are impressed into the side of the edge of the web to allow venting and distribution of the glue. These pockets interlock to allow distribution of glue from one to another and vary in depth, growing deeper as the bottom of the web is approached. The uppermost impressions 85 extend above the web/chord interface line 77 to allow venting of the glue above the member into which the web is inserted.

The impressions of FIGS. 14, 15, 16 and 17 can all be formed in the edge 27 of the web utilizing the devices of FIGS. 8, 9 or 10 by simply changing the shape of the faces of such devices.

FIG. 18 shows a completed I-beam truss structure in which the web 21 is inserted into grooves 17,19 in the upper and lower chords 13 and 15 according to one of the above-described web embodiments. Attached to the upper surface of the upper chord 17 is a panel 87. Where I-beams, such as the one shown in FIG. 18, are used in roof systems having plural panels, such as plywood, forming a flat deck, the nails which are used to attach the roof to the truss must be on very close centers, such as two inches, often causing the truss to split. In addition, roof panels may join above the axis of the upper chord, so that the upper chord must transfer such shear forces from one panel to another, and to the truss structure. The thickness of the strips 87 lessens penetration of the nails into the chord of the truss and tends to reduce the possibility of splitting. In addition, the shear strength of the plywood 87 distributes the shear load from panel to panel, whether the panels are attached by nails or other means. These strips 87 can be attached to the upper chord 13 by any suitable means, such as gluing. The strips 87 themselves resist splitting because of the cross grains of the various layers of wood comprising the plywood.

What is claimed is:

1. A forming device comprising:

at least one forming roller with an outer surface for repeatedly compressing a surface of a wooden sheet adjacent an edge of the sheet to form indentations, the roller being rotatably mounted eccentrically about an axis to cause a repeated but varying amount of compressive contact between the roller and the wooden sheet as the roller rotates;

said axis being inclined with respect to the wooden sheet so as to form indentations of varying depth at the edge of the wooden sheet, the indentations having their depth generally increasing toward the edge of the sheet.

2. A forming device as defined in claim 1, further comprising a pair of co-planar forming rollers in an inclined orientation to one another, the rollers being adapted to compress opposing sides on an edge of a sheet of wood as the forming rollers are rotated, to form adjacent tapered scallops along said edge of the wooden sheet.

3. A forming device as defined in claim 1, further comprising pattern means on the outer surface of the forming roller for forming indentation shapes corresponding to the shape of the pattern means.

4. A forming device for impressing indentations of a selected shape or pattern into a surface of a sheet of wood adjacent an edge thereof, comprising:

roller means rotatably mounted for engaging the edge of a sheet of wood; and forming means on said roller means, having a surface shape and pattern for compressing the wood and leaving an impression on the wood corresponding to the shape and pattern of said forming means, said forming means forming impressions having a depth which generally increases toward the edge of the wood.

5. The forming device of claim 4 wherein the depth of the impressions vary in a direction generally parallel to the edge of the sheet.

6. A forming device as defined in claim 4 wherein the rollers form impressions further having a width which generally increases toward the edge of the wood.

7. A forming device as defined in claim 4 wherein the rollers have a generally conical shape, and are mounted on rotatable axes which are substantially parallel.

8. A forming device as defined in claim 4 wherein the surface shape and pattern of the rollers form scallops in the surface of the wood sheet.

9. A device for impressing indentations of a selected shape into a surface of a sheet of wood adjacent an edge thereof, comprising:

first gear means mounted to rotatably contact a sheet of wood adjacent the edge thereof for compressing the wood with a face of at least one gear tooth on said first gear means and leaving indentations corresponding to the shape of, and pattern on the indenting face of the gear teeth, said gear means forming the indentations on the wood at intervals corresponding to the space between the gear teeth and second gear means the same as said first gear means, said second gear means being adjacent the first gear means and having its gear teeth spaced such that the indentations formed by the second gear means occur on the same surface as, and substantially in the space between, the indentations formed by the first gear means.

10. A forming device as defined in claim 9 wherein the rotating gears are mounted on inclined axes so the gear teeth form indentations having a depth which increases toward the edge of the sheet of wood.

11. A forming device as defined in claim 9 wherein the gear teeth form indentations having a width which increases toward the edge of the sheet of wood.

12. A forming device as defined in claim 9 wherein the shape of and pattern on the gear teeth form impressions of varying depth and width.

* * * * *